US005655275A

United States Patent [19]

Allison et al.

[11] Patent Number: 5,655,275

[45] Date of Patent: Aug. 12, 1997

[54] ADJUSTMENT AND CLEANING MECHANISMS FOR COMPRESSIVE SHRINKAGE APPARATUS

[75] Inventors: Earl S. Allison, Kannapolis; Robert J. Hughes; Barry Defoy Miller, both of Lexington, all of N.C.

[73] Assignee: Tubular Textile LLC, Lexington, N.C.

[21] Appl. No.: 714,891

[22] Filed: Sep. 17, 1996

[51] Int. Cl.[6] ..... D06C 21/00

[52] U.S. Cl. ..... 26/18.6

[58] Field of Search ..... 26/18.6, 18.5, 26/99; 162/111, 280, 281, 361

[56] References Cited

U.S. PATENT DOCUMENTS

| | | | |
|---|---|---|---|
| 3,973,303 | 8/1976 | Diggle, Jr. | 26/18.6 |
| 4,142,278 | 3/1979 | Walton et al. | 26/18.6 |
| 4,717,329 | 1/1988 | Packard et al. | 26/18.6 |
| 4,882,819 | 11/1989 | Milligan et al. | 26/18.6 |
| 5,012,562 | 5/1991 | Catallo | 26/18.5 |
| 5,016,329 | 5/1991 | Milligan et al. | 26/18.6 |
| 5,117,540 | 6/1992 | Walton et al. | 26/18.6 |
| 5,553,365 | 9/1996 | Catallo | 26/18.6 |

*Primary Examiner*—Amy B. Vanatta
*Attorney, Agent, or Firm*—Schweitzer Cornman Gross & Bondell LLP

[57] ABSTRACT

A mechanical compressive shrinkage machine, especially for tubular and open width knitted fabrics, and of the type comprising feeding and retarding rollers cooperating with entry side and exit blades forming a compressive shrinkage zone between the rollers, is provided with novel and improved adjusting mechanisms. For each of the blades, there is a separate adjusting mechanism, each comprising, at each side of the machine, an in-line fluid cylinder, a technician-accessible independent adjustment, and a rotatable eccentric. The rotatable eccentrics on each side are carried by a common shaft, which is accessible externally and provides an operator-controlled adjustment. After initial setup of the machine by a skilled technician, adjustment of the machine by the production operator is effected by rotation of a control shaft, effecting simultaneous movement of the control linkage at opposite sides of the machine. The limits of production operator control, even with full rotation of the control shaft, are such, by design of the eccentric portions of the shaft, as to be within a safe range, to avoid damage or destruction of delicate critical parts of the equipment through careless operator action. The in-line fluid actuators, incorporated into the adjustment linkage, enable rapid, gross movement of the elements for the purpose of reconfiguring the machine in a wide open condition for cleanout. Such reconfiguration is carried out by a predetermined sequence to avoid damage to the components.

8 Claims, 4 Drawing Sheets

12
47
13
11
22
59
57
60
61
58
55
17
79
80
14
77
81
15
78
16
75
10
46

FIG. 3
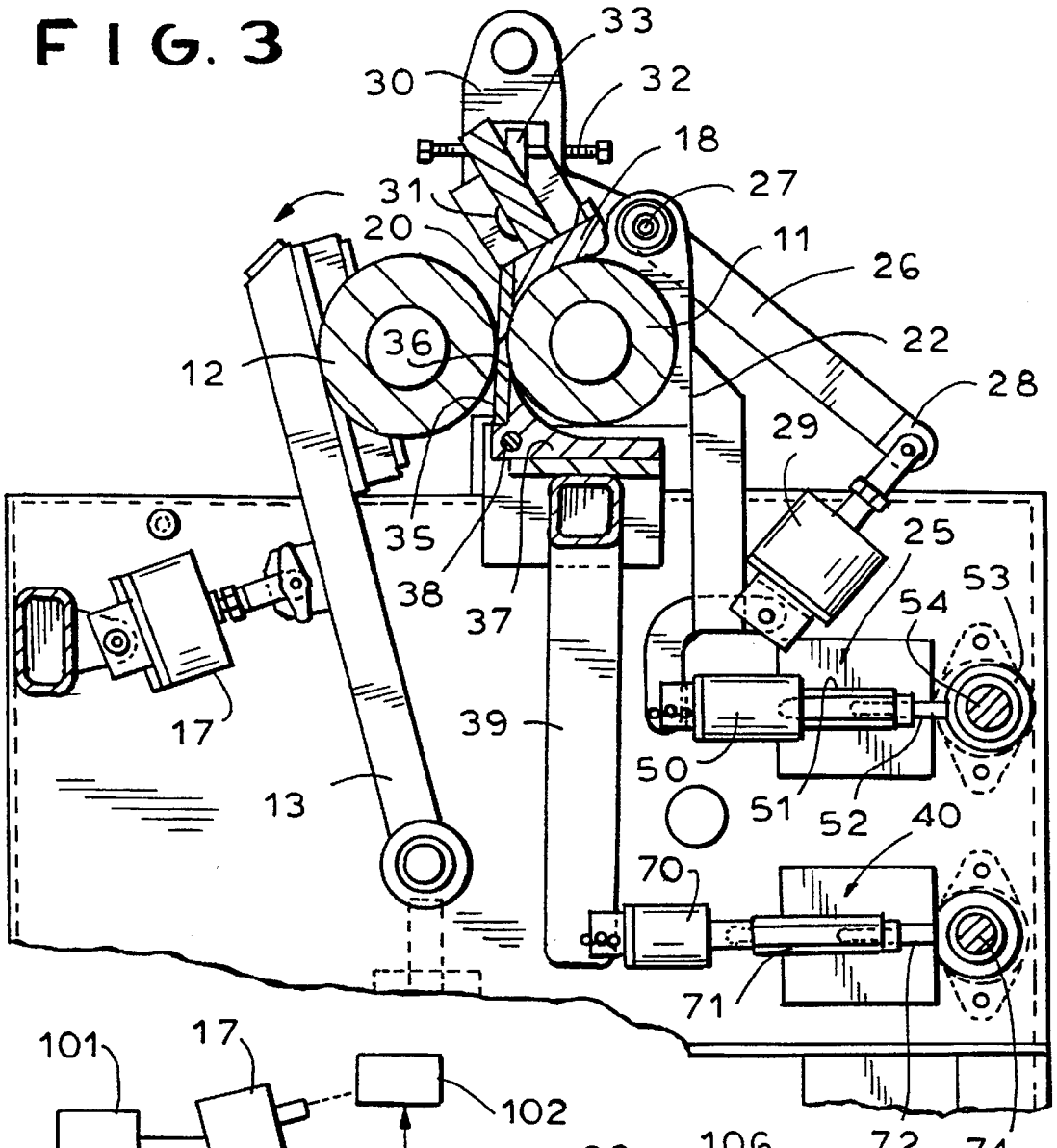
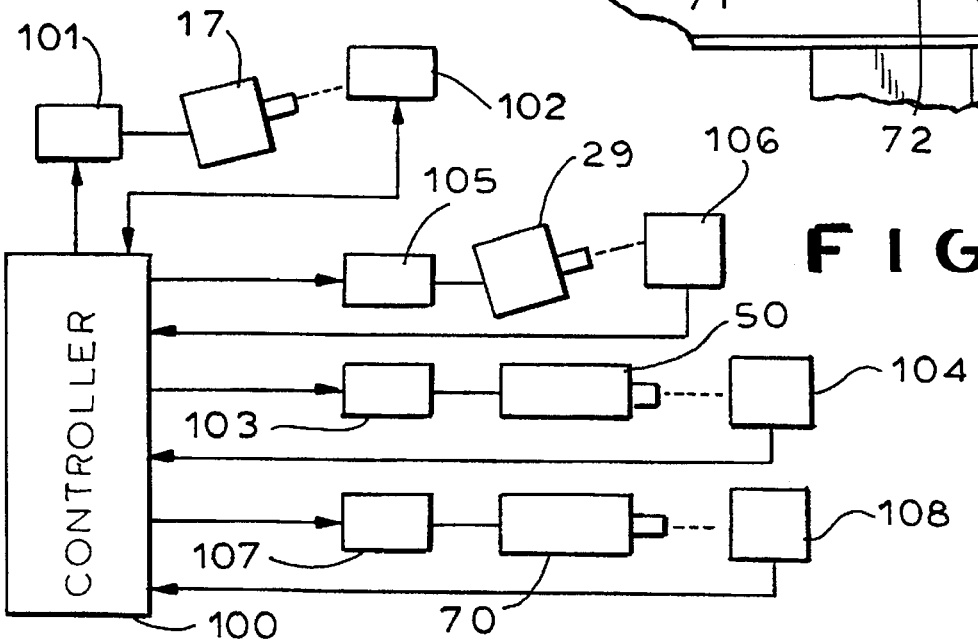
FIG. 5

ADJUSTMENT AND CLEANING MECHANISMS FOR COMPRESSIVE SHRINKAGE APPARATUS

This application claims priority of provisional application Ser. No. 60/004,030, filed Sep. 20, 1995.

RELATED CASES

The present invention is directed particularly to improvements in mechanical compressive shrinkage apparatus of the general type disclosed and claimed in Milligan et al. U.S. Pat. No. 4,882,819 and 5,016,329, owned by Compax Corp., of Lexington, N.C. The disclosures of said patents are incorporated herein by reference.

BACKGROUND AND SUMMARY OF THE INVENTION

In the processing of knitted fabrics, both tubular and open width, one of the important processing steps involves expanding the width of the fabric and compressing or compacting it in a lengthwise direction, so that the finished fabric is in a substantially relaxed and normalized state, as free as practicable of residual shrinkage or growth that could significantly effect the shape and size of finished garments made therefrom. During normal processing, and particularly when wet, knitted fabric is geometrically unstable and tends to become stretched and elongated in the lengthwise direction and correspondingly narrowed in width. Spreading and compacting are thus typically performed as finishing operations, in order to eliminate the severe distortions that occur during earlier processing.

In the Milligan et al. U.S. Pat. No. 5,016,329, an advantageous form of compressive shrinkage apparatus is described, which comprises opposed feeding and retarding rollers mounted for controlled rotation on spaced, parallel axes. These axes form a reference plane which extends between the two rollers at their point of closest approach, where the surfaces of the rollers are spaced apart by a short distance, for example about a ¼ of an inch. An entry side confining shoe, with a blade extension at its discharge or downstream edge, is disposed about a portion of the feed roller surface, for example about 90° C., and serves to confine fabric over its entire width, as the fabric is advanced by the feed roller toward a compressive shrinkage zone located substantially at the before mentioned reference plane. An exit side confining surface conforms to a portion of the surface of the retarding roller, and has a blade-like extension projecting substantially to the reference plane and confronting the entry side blade extension. The end surfaces of the respective blade extensions are disposed at an angle to the reference plane, such that fabric conveyed by the feeding roller is diverted sharply from the surface thereof and is directed into and through a compressive shrinkage zone defined by confronting surfaces of the respective blade extensions.

As the fabric emerges from the shrinkage zone, it immediately contacts the surface of the retarding roller, and is confined against such surface, by conforming portions of the exit side confining surface. The respective feeding and retarding rollers are separately controllably driven, such that the fabric is advanced toward and into the compressive shrinkage zone at one predetermined speed, and is conveyed away from the discharge side of said zone at a controllably lower speed by the retarding roller. As described in the before mentioned patents, lengthwise compressive shrinkage of the fabric is efficiently accomplished within a short compressive shrinkage zone defined by the angled, confronting surfaces of the respective blade extensions.

As can be appreciated, accurate adjustment of the positioning and relationship of the respective blade-like extensions with respect to each other and with respect to the driven rollers, particularly the feed roller, is critically important to uniform, high quality results in the compressive shrinkage operation. Of particular importance in this respect is the spacing between confronting surfaces of the respective blade-like extensions, which defines the thickness of the compressive shrinkage zone, and clearance spacing between the uppermost tip of the exit side blade-like extension and the surface of the feed roller.

One advantageous feature of the new apparatus includes a simplified and reliable, yet wholly foolproof mechanism to enable production operators of the equipment to make necessary adjustments of blade positioning, while at the same time preventing excess adjustment, such as might cause direct contact between a blade and an adjacent roller. In this respect, such contact, particularly when the equipment is in motion, can cause severe damage to the blades, and in many cases the rollers as well, resulting in expensive repairs and substantial downtime of the equipment. The described mechanism permits and enables non-technically skilled production operators to adjust the equipment only within predetermined limits which prevent damaging contact and which are substantially fail-safe even against operator abuse. To this end, for the critical adjustments required, primary and secondary adjustment means are provided. The primary adjustment means are accessible to and intended to be manipulated only by skilled technical personnel during machine setup and/or maintenance, being otherwise normally fixed. Secondary adjustment is provided by means of rotatable eccentric shafts. The shafts are designed and intended for rotation through a limited angle, for example 80° or 90° C., intended to provide sufficient adjustment to accommodate normal day-to-day variation in fabric types etc. Moreover, the eccentric shaft means are so arranged that the maximum possible adjustment in a "closing" direction, even if the shafts are improperly rotated throughout a greater angle than intended, is limited so as to avoid damage to the equipment.

In the operation of the compressive shrinkage apparatus described above, over a long period of time, can result in accumulations of stray fibers and the like, which may degrade performance. Accordingly, periodic cleaning of the machine is desirable, particularly when changing the line from one fabric type to another. In the new apparatus, there is advantageously incorporated in the adjusting mechanisms described above in-line fluid actuator devices which, in one position, constitute an integral and effectively fixed part of the adjusting mechanism but which can be actuated, when desired, to quickly move the respective entry side and exit side blade elements to open positions, well spaced from the respective feeding and retarding rollers. In these wide open positions, the equipment can be cleaned swiftly and efficiently by the use of an air hose, for example. In the past, such cleaning has been difficult and time consuming, in many cases involving undesired readjustment of the machine settings. The system of the invention, which provides for expedited cleaning, includes safety control facilities which in the first instance enable operation only when the machine is stopped and, in the second instance, assure that elements of the equipment are opened to their respective cleaning positions in a predetermined sequence, assuring that there is no unintended contact that could result in damage to delicate parts.

For a more complete understanding of the above and other features and advantages of the invention, reference should be made to the following detailed description of a preferred embodiment of the invention and to the accompanying drawings.

DESCRIPTION OF THE DRAWINGS

FIG. 3 is a fragmentary cross sectional view as taken generally on line 3—3 of FIG. 2.

FIG. 5 is a highly simplified schematic representation of a control system for assuring proper sequential actuation of mechanisms during opening movements in preparation for cleaning.

DESCRIPTION OF PREFERRED EMBODIMENTS

Figure 1:
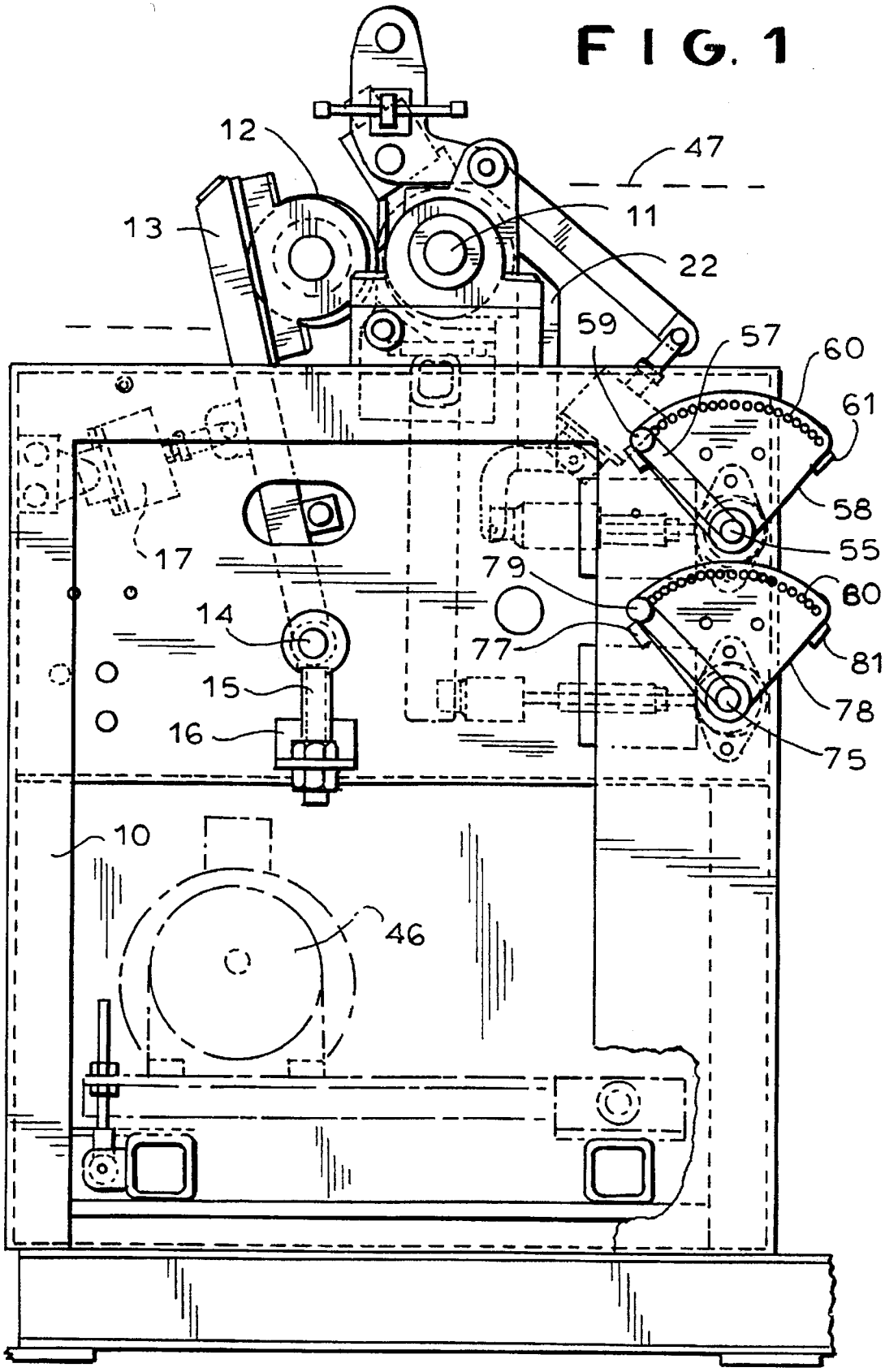
FIG. 1 is a side elevational view of a two roll compressive shrinkage apparatus incorporating features of the invention.

Referring now to the drawings, FIG. 1 shows a typical form of single station compacting apparatus incorporating the invention. The apparatus includes a frame 10 which supports a feed roller 11 for rotation about a fixed axis. The feed roller 11 advantageously is of hollow metal construction, with provisions (not shown) for passing a heating medium through the hollow interior. A retarding roller 12, typically and advantageously provided with an outer layer of resilient material, is mounted on pivot arms 13 mounted on a pivot shaft 14. The pivot shaft is mounted by eye bolts 15 and brackets 16 for vertical adjustment on the frame 10, such that the retarding roller 12 is positioned substantially at the same level as the feed roller 11, with the respective axes of the feeding and retarding rollers being parallel and defining a reference plane. Fluid actuators 17, mounted on the frame 10 engage the pivot arms 13 for moving the retarding roller 12 toward and away from the feeding roller 11.

Figure 4:
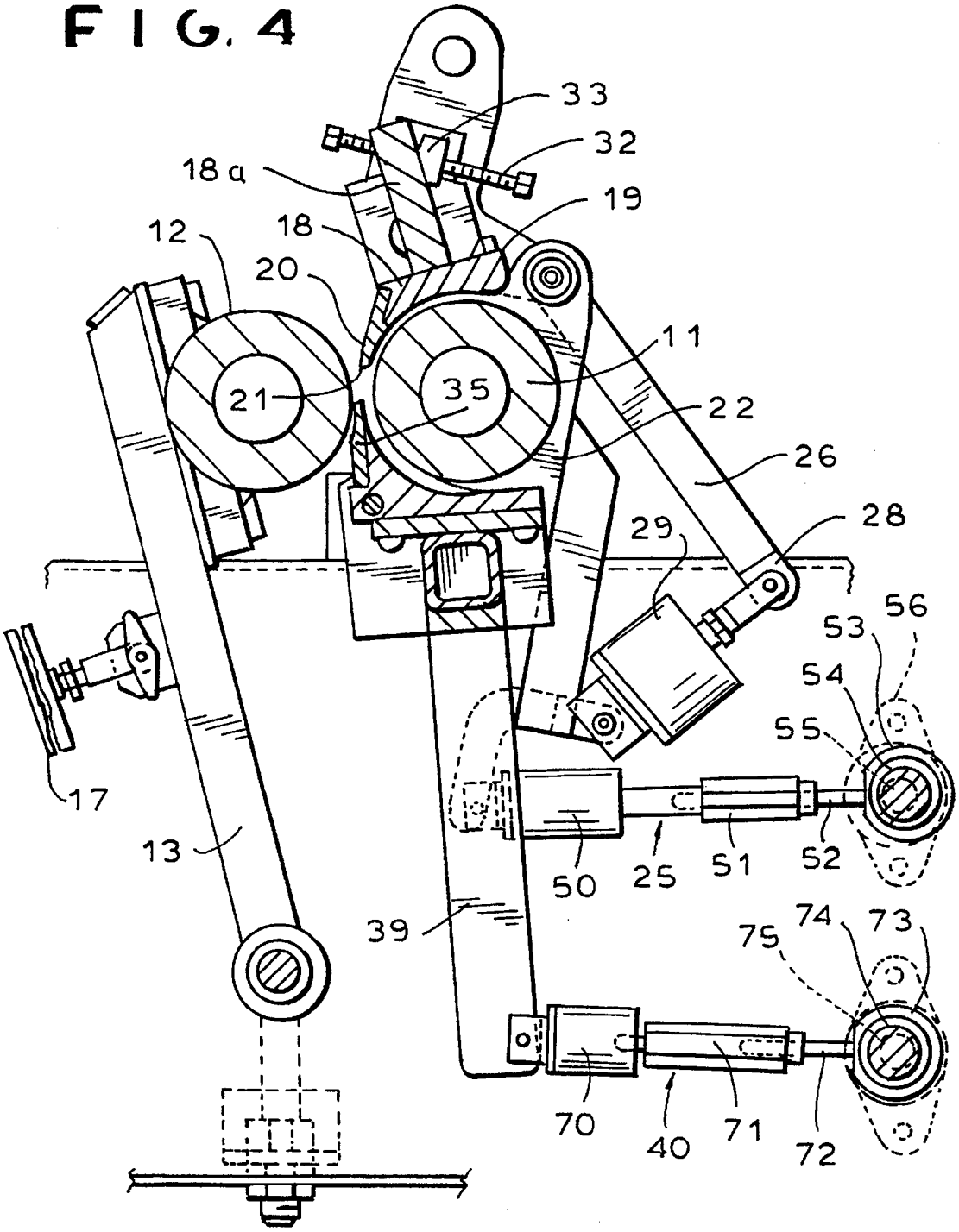
FIG. 4 is an enlarged view, similar to FIG. 3, illustrating the mechanisms of the apparatus in an open position for cleaning.

With reference particularly to FIGS. 3 and 4, an entry side confining shoe 18 braced by a transverse T-bar 18*a* is associated with the feed roller and has an arcuate surface 19 which conforms to the surface of the feed roller over a predetermined arc. At the discharge side, the confining shoe 18 mounts a blade-like extension 20 which is arcuately contoured in its lower portion to conform closely to the surface of the feed roller 11 and on the opposite side to clear the surface of the retarding roller 12. The lower surface 21 of the blade extension 20 is disposed at an angle such that, when the elements are in an operating position as shown generally in FIG. 3, the surface 21 is at an angle of approximately 45° C. to the reference plane containing the axes of the respective feeding and retarding rollers 11, 12.

As described in the before mentioned Milligan et al. patents, the entry side shoe is mounted for compound adjustment. To this end, primary levers 22 are mounted at each side, pivoted on shaft extensions 23 extending from each end of the feeding roller 11. The roller itself is journaled by these same shaft extensions, by means of pillow blocks 24. The rotational position of the primary levers 22 is controlled by a novel adjusting mechanism generally indicated at 25, to be described hereafter.

Secondary levers 26 are pivoted at 27 on the primary levers 22 and are connected to the primary levers at one end 28 by means of fluid actuators 29. The secondary levers 26 include an upwardly extending arm 30 providing a pivot 31 for mounting of the entry side confining shoe 18. The rotational position of the shoe 18 on the pivot 31 is adjusted and controlled by means of opposed bolts 32, carried by the arm 30, and bearing upon opposite sides of blocks 33 fixed to the T-bar 18*a* at each end.

As will be understood, the entry side shoe 18 is adjustable angularly with reference to the rotational axis of the feeding roller 11, by movement of the primary lever 22. For any given rotational position determined by the primary levers 22, the shoe 18 may be moved in a generally radial direction, toward or away from the surface of the roller 11, by movement of the levers 26, under control of the actuators 29.

An exit side confining surface and blade combination is formed by a rigid blade-like element 35, which extends upwardly between the feeding and retarding rollers 11, 12 and has an upper end edge surface disposed at an angle of approximately 45° C. to the reference plane, to conform substantially with the opposing surface 21 of the upper blade extension 20. The blade 35 is formed with an arcuately concave outer confining surface portion 36 arranged to conform with the outer surface of the retarding roller 12. The lower blade element 35 is rigidly secured to and carried by a mounting block 37 pivoted in the frame 38 at a position generally directly below the blade 35. Positioning of the blade 35 is controlled by primary levers 39, at opposite sides of the machine, which are positioned by adjusting mechanisms, generally designated by the numeral 40, to be described hereinafter. The mechanisms 40, pivoting the levers 39 about the pivot element 38, serve principally to move the blade element 35 toward and away from the feeding roller 11, without significantly changing the vertical position of the blade.

Figure 2:
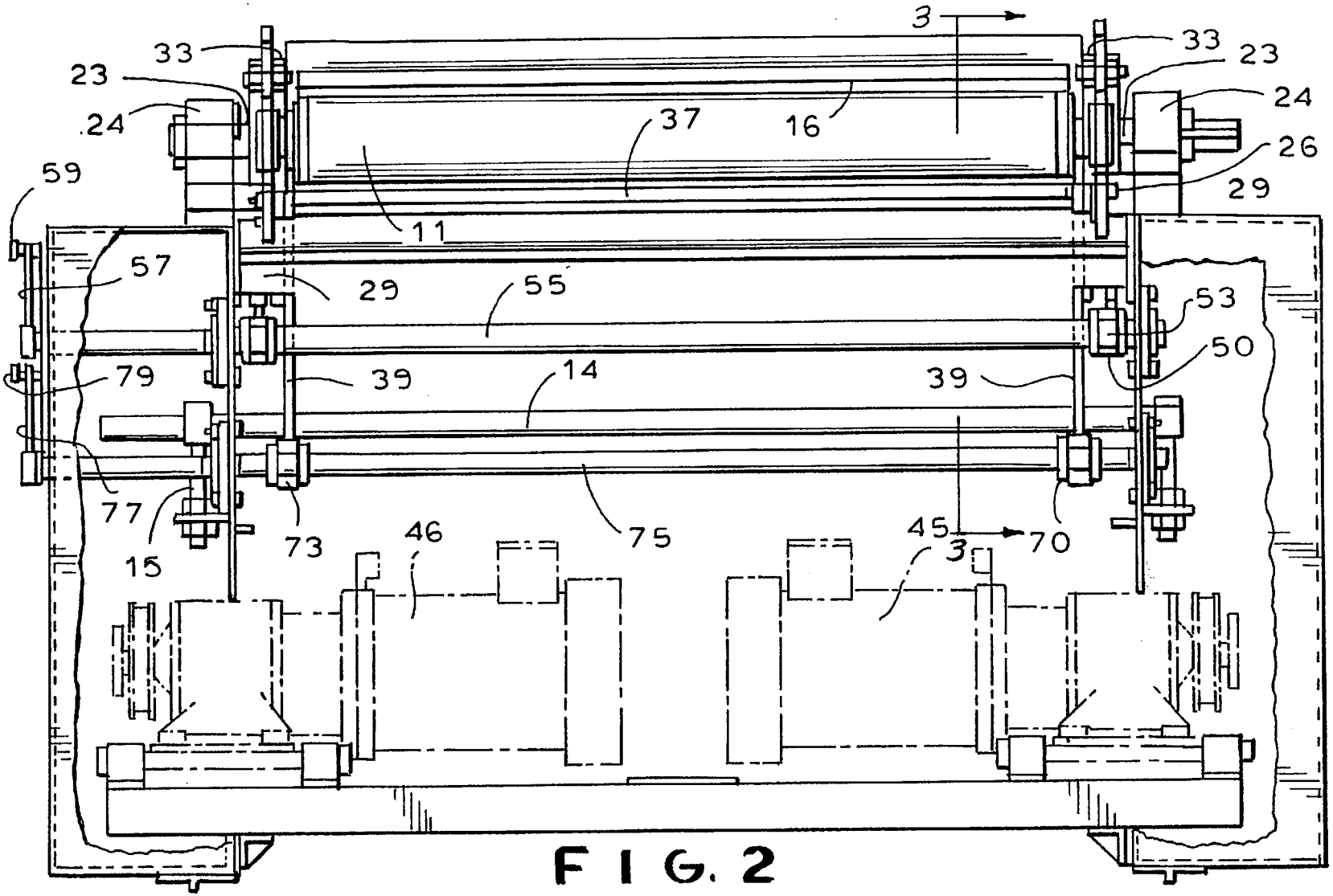
FIG. 2 is an end elevational view of the apparatus of FIG. 1, with parts broken away.

The respective feeding and retarding rollers 11, 12 are driven by separate, individually controllable motors 45, 46 (FIG. 2) to provide independent speed control.

In typical operation of compressive shrinkage apparatus of the type described, knitted fabric 47, in tubular or open width form, is advanced at preset width into a confined space between the entry side shoe 18 and the feed roller 11. The surface of the feed roller 11 is of a character to frictionally grip the material and advance it at a constant speed toward the compressive shrinkage zone formed by confronting angular surfaces of the respective blades 20, 35. As the fabric reaches the compressive shrinkage zone, it is diverted into that zone and, upon exiting from the zone, moves into confinement between the surface of the retarding roller 12 and the arcuate confining surface 36 of the exit side blade element 35, the retarding roller being urged toward the blade element 35 by controlled pressure in the actuator 17. The retarding roller 12 is controlled to operate at a surface speed controllably less than that of the feeding roller 11, so that the fabric is decelerated and compacted in the short compressive shrinkage zone, all as described in the before mentioned Milligan et al. U.S. patents.

In the processing of various materials, different adjustments of the blades 20, 35 are required, to accommodate materials of different thickness, different stitch construction, etc. Adjustments of primary importance that have to be made on a regular production basis are the positioning of the lower blade 35 to adjust the gap between it and the surface of the feeding roller 11, and adjustment of the gap between the upper blade element 20 and the lower blade element 35, in order to control the thickness of the compressive shrinkage zone. Both of these adjustments must be very precise. The apparatus of the invention incorporates adjusting mechanisms that permit these adjustments to be repeatably performed by production personnel, who may not be technically skilled. Additionally, and very importantly, the adjusting mechanism provided by the invention effectively prevents overadjustment that might result in contact between the blades and the rolls, which could quickly result in the damage or destruction of either or both.

With reference now to FIGS. 3–5, the adjusting mechanism 25 for each of the respective primary levers 22 (one at each side of the machine) comprises a short stroke, normally retracted fluid actuator 50, the movable rod of which is connected to an adjustable turnbuckle 51. The opposite end of the turnbuckle is joined with a connecting rod 52 extending from a circular bearing 53. The bearing 53 is rotatably connected to an eccentric portion 54 of a shaft 55 extending transversely across the machine and mounted for rotation by bearings 56. One end of the shaft 55 projects outward of one side of the machine and is connected with an operating arm 57 associated with a quadrant plate 58. At its outer end, the arm 57 has a retractable pin mechanism 59 cooperating with a succession of holes 60 in the quadrant plate. The pin assembly 59 can be resiliently retracted to allow movement of the lever 57. When released, the pin assembly has an element which enters one of the holes 60 to retain the lever in a particular adjusted position.

For normal operations, with the fluid actuators 50 fully retracted, the actuators effectively constitute a rigid part of the linkage joining the levers 22 with the adjusting shaft 55. Initially, the arm 57 can be set to a limit position, in which the eccentric portions 54 of the shaft 55 are set to a position of maximum eccentricity. With the equipment in this configuration, a technician can adjust the turnbuckles 51 at each side to effect a precise initial adjustment of the linkage 25 to set the upper blade 20 in its lowest permitted position. Thereafter, during normal operation of the equipment, the turnbuckles remain fixed and adjustment is effected exclusively by manipulation of the lever 57, which is accessible to the production operator.

The adjustment linkages 40 are of similar construction to the linkages 25 described above, although short stroke fluid actuators 70, pivotally connected to the levers 39, are maintained in a normally extended condition. Adjustable turnbuckles 71 join with threaded rods 72. These are connected to bearings 73 engaging eccentric portions 74 of a transverse shaft 75. The shaft 65 projects from the control side of the machine and mounts a control lever 77 carrying a retractable pin mechanism 79 associated with a quadrant plate 78. The quadrant plate 78 is formed with a series of holes 80, corresponding to the holes 60 of sector plate 58, for confining motion of the control lever 77. In a preferred embodiment of the invention the normal range of production adjustment of the lower blade provides for a blade-to-feed roller gap of 0.003 inch to 0.018 inch, in increments of 0.0006 inch between sector plate holes 60. The openings in the quadrant plates can be calibrated and marked for repeatability of settings.

Preferably, at least the actuators 50, 70 associated with the adjustable linkages 25, 40, are style S square air cylinders marketed by Compact Air. In a preferred and illustrative embodiment these cylinders may have a bore of 1⅜ inch, with a two inch stroke for the upper cylinder 50 and a 1.25 inch stroke for the lower cylinders.

Initial adjustment of the mechanisms 40 can be made generally in the same as for the control linkages 25, by setting the control lever 77 and shaft 75 in limit positions while a technician makes precise initial adjustments of the turnbuckles 71 at each side to set the lower blade at its minimum permissible clearance with respect to the feed roller 11.

For production adjustments, the width (thickness) of the compressive shrinkage zone is controlled by means of the upper lever 57, which may be set in any of a large plurality of positions within the limits of the sector plate. The effect of this adjustment is to move the upper blade extension 20 incrementally toward or away from the lower blade 35. With the lower control lever 77, the uppermost tip of the lower blade 35 may be incrementally moved in a generally horizontal direction toward and away the surface of the feed roller 11. This enables rapid, highly repeatable, accurate adjustment of the critical blade positions to be performed as necessary during normal production operations, to accommodate different fabrics and/or to make minor adjustments during the processing of a given fabric over an extended period.

The control linkages 25, 40 of the invention are inherently fail-safe, in that, even with excessive rotation of the shafts 55, 75 beyond the limits of the quadrant plates 58, 78, the eccentric shaft portions 54, 74 have a limited maximum displacement from the rotational axes of the respective shafts. Thus, in "production" adjustments, even if the normal rotational limits of the shafts are exceeded, the limits are such that the elements cannot be adjusted into positions that would result in serious damage or destruction.

In one advantageous embodiment of the invention, the upper adjusting shaft 55 may have an eccentric portion 54 offset approximately 0.25 inch, providing for a maximum displacement of the lower ends of the levers 22 of approximately ½ inch. As is evident in FIG. 3, for example, the levers 22 are designed such that the distance from the pivot axis to the linkage mechanism 25 is a multiple of the distance from the pivot axis to the blade extension 20, so that the total potential motion of the blade extension 20, assuming even a full rotation of the shaft 55, is less than ⅛ of an inch, and only in the "safe" direction. The lower shaft 75 may, in a preferred embodiment, have a maximum displacement of its eccentric portion 74 of approximately ⅛ inch, such that the maximum horizontal displacement of the tip of the lower blade 35 is less than 1/16 of an inch, only in the "safe" direction. Thus, the permitted production adjustments of the machine cannot accidentally exceed safe limits so as to cause serious damage and downtime.

In normal production processing of fabric on the equipment, there is some inevitable minor abrasion of the fabric, particularly in the area of the compressive shrinkage zone, where the fabric is diverted abruptly from the surface of the feed roller 11 and caused to travel at reduced speed through the zone defined by the upper and lower blade extensions 20, 35. Thus, periodically, and particularly where fabrics of different styles or colors are supplied to the apparatus, it is desirable to clean away any accumulations of loose fibers that may occur in the region of the compressive shrinkage zone. To this end, the adjusting mechanism advantageously employs the in-line fluid actuators 50, 70, in conjunction with the fluid actuators 17, associated with the retarding roller, and the actuators 29, associated with the levers 26 controlling radial positioning of the entry side confining shoe 18.

In the system of the invention, cleaning of the equipment in the area of the compressive shrinkage zone is quickly and expeditiously accomplished by controlled operation of the before mentioned fluid actuators, quickly moving the machine components to a wide open, separated configuration, as shown in FIG. 4. In this configuration, a machine operator can direct an air hose, for example, along the area of the blade extensions 20, 35 to quickly remove any fiber accumulations. The equipment may thus be cleaned and returned to service in a matter of a few seconds whereas, heretofore, the cleaning operation has typically required rather laborious readjustments, with the resulting time-consuming requirement of carefully restoring the pre-existing machine settings.

With the system of the invention, the several fluid actuators 17, 29, 50, 70 are controlled and coordinated for a desired sequential actuation for quickly opening the machine to the FIG. 4 configuration. For this purpose, there is provided a control system as schematically represented in FIG. 5, which enables the various components to be actuated in a desired sequence to avoid interference and possible damage. Thus, a controller 100, which can be operated only when the equipment is not running, can be controllably initiated by the machine operator to commence the opening process. Initially, a solenoid valve 101 is actuated to cause the fluid actuator 17 to retract, moving the support arms 13 and the retarding roller 12 away from the fixed feed roller 11, providing a large gap between the two rollers 11, 12. When the retarding roller 12 has been fully retracted, a limit sensor 102 is actuated, causing the controller 100 to actuate a second solenoid valve 103 to fully extend the fluid actuator 50 of the adjusting linkage 25, rotating the lever 22, confining shoe 18 and blade extension 20 in a clockwise direction, away from the lower blade 35, as reflected in FIG. 4.

When full extension of the actuator 50 is indicated, by actuation of a limit sensor 104, the controller 100 actuates a solenoid valve 105, initiating retraction of the fluid cylinder 29. This serves to pivot the lever 26, clockwise relative to the lever 22, resulting in the confining shoe and blade extension 20 being lifted in a generally radial direction off of the surface of the feed roller 11, to provide a clearance space for cleaning. A limit sensor 106 detects when the actuator 29 has fully retracted, and through the controller 100, actuates a solenoid valve 107 to initiate retraction of the fluid actuator 70 forming part of the adjustment linkage 40. This causes the lever 39 to pivot in a counterclockwise direction, moving the lower blade 35 away from the feed roller 11 and providing a clearance space for cleaning. A limit sensor 108 indicates when this last operation has been concluded.

With the apparatus in the open configuration reflected in FIG. 4, the operator can easily direct a high pressure air nozzle into the clearance areas thus provided, quickly removing any accumulated fiber and readying the machine for further production.

To restore the machine to production configuration, as in FIG. 3, the controller 100 carries out the above described operations in reverse, first extending the actuator 70 to restore the lower blade to its operating position, close to the surface of the feed roller 11, and then extending the actuator 29 to move the confining shoe and blade extension 18, 20 to a position closely conforming to the surface of the feed roller 11. This is followed, in sequence, by retraction to a fixed position of the fluid actuator 50 and extension of the fluid actuator 17, first to rotate the entry side shoe and blade extension 18, 20 into their normal operation positions, and then to bring the retarding roller 12 back to its normal operating position closely confronting the lower blade 35.

The mechanisms of the invention, associated with a control system of the general type reflected in FIG. 5, enable an efficient and effective cleanout of the apparatus to eliminate fiber accumulations. The opening operation is carried out in an automatic sequence, in a manner to avoid damage to delicate parts, as is the subsequent sequence of operations for reclosing of the apparatus and restoring it to its production adjustments. The entire operation is completed without affecting the prior precision adjustment of the equipment, as the actuators 50, 70 are returned to fixed, end-of-stroke positions, and the actuators 17, 29 are, if fabric is in the machine, returned to predetermined pressure contact with the fabric.

The apparatus of the invention is extremely efficient and effectively foolproof, providing for rapid, precise production adjustment of the compressive shrinkage machine while reliably assuring that a careless production operator will not cause damage to the critical elements of the equipment. The entry and exit blade elements of the equipment incorporate independent, technician-accessible adjustments at each side, in conjunction with a separate operator-controlled adjustment which is effective simultaneously on both sides of the equipment. By limiting the operator-controlled adjustment to the displacement of an eccentric shaft, operator-controlled adjustment can be effectively limited to a safe range, to avoid machine damage.

The adjustment mechanisms also incorporate in-line fluid actuators which enable rapid, gross movement of the compactor blades in an opening direction, allowing the machine to be quickly and safely configured in a wide open condition for easy cleaning.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. In a mechanical compressive shrinkage apparatus of the type comprising feeding and retarding rollers having respective longitudinal axes arranged in spaced parallel relation, said rollers defining a working space between them, opposed entry side and exit side blade elements projecting from opposite sides into said working space and defining between free ends of said blade elements a confined compressive shrinking zone extending across said space at an angle to a reference plane containing the axes of said rollers, means mounting said exit side blade element for movement of its free end toward and away from said feeding roller, means mounting said entry side blade element for movement toward and away from said exit side blade element for adjustment of said compressive shrinking zone, and controllable adjustment means for movement of said exit side blade element and said entry side blade element, and improvement in said controllable adjustment means characterized by, (a) first and second pairs of movable control linkages, connected to opposite ends of said entry side and exit side blade elements, respectively, (b) each said movable control linkage comprising a normally fixed, technician-accessible adjusting element for independently adjusting the length of said linkage, (c) each said movable control linkage further comprising a bearing element, (d) first and second eccentric shaft means connected to the bearing elements of the respective first and second pairs of control linkages, (e) said shaft means being accessible externally of said apparatus and forming an operator-accessible means for simultaneously adjusting the positions of the control linkages for the respective blade elements.

2. An apparatus according to claim 1, wherein (a) said shaft means each include spaced-apart eccentric portions associated with said bearing elements, (b) said first shaft means and the technician-accessible adjusting means for said first pair of control linkages are so arranged that, upon maximum displacement of said entry side blade toward said exit side blade by rotation of said first shaft means, said entry side blade is spaced a predetermined minimum distance from said exit side blade, and (c) said second shaft means and the technician-accessible adjusting means for said second pair of control linkages are so arranged that, upon maximum displacement of said exit side blade toward said feeding roller by rotation of said second shaft means, said exit side blade is spaced a predetermined minimum distance from the surface of said feeding roller.

3. An apparatus according to claim 2, wherein (a) a quadrant plate having a plurality of calibrated openings is associated with each of said eccentric shaft means, (b) each said shaft means carries an operator accessible control lever, and (c) each said control lever carries a retractable pin device, cooperating with said calibrated openings in said quadrant plates, for adjustable setting of said shaft means in predetermined rotary positions.

4. An apparatus according to claim 1, wherein (a) each of said movable control linkages includes an in-line fluid actuator, (b) said fluid actuators normally being in an end-of-stroke position whereby to normally constitute fixed elements of said linkages, and (c) said fluid actuators being adapted for selective operation to effect a gross change in the length of said linkages for moving said blade elements to an open position for cleaning.

5. An apparatus according to claim 4, wherein (a) control means are provided for moving said entry side blade element to an open position in advance of said exit side blade means.

6. An apparatus according to claim 5, wherein (a) positioning actuator means are provided for moving said retarding roller toward and away from said feeding roller, and (b) said control means are operative to move said retarding roller away from said feeding roller in advance of movement of said exit side blade element to an open position.

7. In a mechanical compressive shrinkage apparatus of the type comprising feeding and retarding rollers having respective longitudinal axes arranged in spaced parallel relation, said rollers defining a working space between them, opposed entry side and exit side blade elements projecting from opposite sides into said working space and defining between free ends of said blade elements a confined compressive shrinking zone extending across said space at an angle to a reference plane containing the axes of said rollers, means mounting said exit side blade element for movement of its free end toward and away from said feeding roller, means mounting said entry side blade element for movement toward and away from said exit side blade element for adjustment of said compressive shrinking zone, and controllable adjustment means for movement of said exit side blade element and said entry side blade element, and improvement in said controllable adjustment means characterized by, (a) first and second pairs of movable control linkages, connected to opposite ends of said entry side and exit side blade elements, respectively, for controlling the positions of said blade elements, (b) each of said movable control linkages including an in-line fluid actuator, (c) said fluid actuators normally being in an end-of-stroke position whereby to normally constitute fixed elements of said linkages, and (d) said fluid actuators being adapted for selective operation to effect a gross change in the length of said linkages for moving said blade elements to an open position for cleaning.

8. An apparatus according to claim 7, wherein (a) control means are provided for moving said entry side blade element to an open position in advance of said exit side blade means.

* * * * *